US009303484B2

(12) United States Patent
Storey et al.

(10) Patent No.: US 9,303,484 B2
(45) Date of Patent: Apr. 5, 2016

(54) DISSOLVABLE SUBTERRANEAN TOOL LOCKING MECHANISM

(71) Applicant: Baker Hughes Incorporated, Houston, TX (US)

(72) Inventors: Bryan T. Storey, Spring, TX (US); Basil J. Joseph, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 397 days.

(21) Appl. No.: 13/872,512

(22) Filed: Apr. 29, 2013

(65) Prior Publication Data

US 2014/0318761 A1 Oct. 30, 2014

(51) Int. Cl.

| | |
|---|---|
| ***E21B 23/02*** | (2006.01) |
| ***E21B 23/06*** | (2006.01) |
| ***E21B 33/128*** | (2006.01) |

(52) U.S. Cl.

CPC ..... *E21B 33/1285* (2013.01)

(58) Field of Classification Search

USPC ..... 166/377, 376, 378

See application file for complete search history.

(56) References Cited

U.S. PATENT DOCUMENTS

| | | | | |
|---|---|---|---|---|
| 3,659,647 | A * | 5/1972 | Brown | 166/120 |
| 5,536,126 | A * | 7/1996 | Gross | 411/411 |
| 6,779,600 | B2 | 8/2004 | King et al. | |
| 7,552,777 | B2 | 6/2009 | Murray et al. | |
| 7,726,406 | B2 | 6/2010 | Xu | |
| 2012/0118583 | A1 | 5/2012 | Johnson et al. | |
| 2012/0279701 | A1 | 11/2012 | Doane et al. | |

* cited by examiner

*Primary Examiner* — David Andrews
*Assistant Examiner* — Ronald Runyan
(74) *Attorney, Agent, or Firm* — Steve Rosenblatt

(57) ABSTRACT

A hydrostatically set packer is held against setting by a locking member that is made of controlled electrolytic material (CEM). After introduction into a wellbore and exposure to thermal or well fluid inputs the lock made of CEM dissolves or is otherwise weakened to the point where relative movement can occur for the setting of the packer with available hydrostatic pressure. The locking member can also be a shape memory alloy at least in part whose shape change allows the tool to set.

19 Claims, 3 Drawing Sheets

DISSOLVABLE SUBTERRANEAN TOOL LOCKING MECHANISM

FIELD OF THE INVENTION

The field of the invention is subterranean tool locking mechanisms and more particularly where the lock directly retains the actuated component until release preferably by dissolving.

BACKGROUND OF THE INVENTION

Packers are widely used in boreholes to isolate a portion of the borehole from another. Some of these packers are set with tubing pressure that either inflates an element or operates a piston to axially compress an assembly of a sealing element and adjacent slips. This is commonly accomplished with a ball dropped on a ball seat so that pressure above the seated ball is communicated to a piston outside the string through a wall opening. The applied pressure breaks any retainers on piston movement and as a result an axial compressive force acts on the seal and slips to set the packer. In other designs the available hydrostatic pressure is used as the driving force to move a piston to in turn set the seal and the slips of a packer. In still other designs the tubular string associated with the packer is manipulated to set the packer.

There are disadvantages to some of these designs. One notable disadvantage is the need to have a wall opening in designs that set the packer with internal tubing pressure. For the packers that set hydrostatically with annulus pressure the can still be wall openings to an exterior piston that opens a port to allow access of annulus pressure to a piston to set the packer. Another technique involves signaling a valve to open at the packer in the annulus from the surface through a variety of techniques such as coded pressure pulses, vibration or movement patterns of a work string. Each of these techniques has disadvantages of cost or limited applicability due to well conditions. The techniques for remote signaling require a local processor and signal receiver.

In some hydrostatically set packers rupture discs have been suggested to provide a backup way to communicate annulus pressure to a piston that would set the packer. As an alternative to a rupture disc 42 U.S. Pat. No. 6,779,600 suggested a disappearing plug to provide a time delay to providing annulus hydrostatic pressure access to the operating piston of the packer. The lock sleeve 32 had its own mechanical restraint in shear pin 46. Movement of the lock sleeve 32 released dog 48 from groove 50 to allow hydrostatic pressure to actuate the packer by moving piston 18 against an atmospheric chamber 24. Breaking the rupture disc 42 or having a plug dissolve let in hydrostatic pressure to break the shear pin 46 to liberate piston 18 to set the packer. This design still depended on a shear pin to break at a designated force and to shear cleanly to allow the parts to relatively move thereafter.

Another design shown in US Publication 2012/0279701 FIG. 8 shows the use of shape memory alloy for plug 202 that is thermally induced to go into another shape to open passage 200 so that hydrostatic pressure moves the piston 206 to break a shear pin that holds ring 210 to release the lock 212 on packer mandrel 214 that allows setting the packer with pipe manipulation and drag blocks. Paragraph 26 alludes to an option to retain a preload force on a piston with a member that is dissolved or chemically attacked to release the force to move the piston. No drawing of this alternative is provided.

Controlled electrolytic materials (CEM) have been described in US Publication 2011/0136707 and related applications filed the same day. These materials dissolve in well conditions.

Also relevant to disappearing plugs are US Publication 2012/0118583; U.S. Pat. No. 7,552,777 (swelling material shifts a sleeve to open a port) and U.S. Pat. No. 7,726,406 (FIG. 4 where core 47 of plug 43 disappears and puts a force on a piton 41 to break retaining shear pin 42 to set the tool.

The above locking mechanisms are all indirect techniques for retaining an actuator that still depend on shear pins and the uncertainties that are involved in their use. The present invention incorporates the mechanical locking member for a tool actuator as the part that goes away so that the tool can be set. More specifically in a hydrostatically set packer has a CEM locking member that dissolves to allow the packer to set. These and other aspects of the present invention will be more readily apparent from a review of the description of the preferred embodiment and the associated drawings while understanding that the full scope of the invention is to be determined from the appended claims.

SUMMARY OF THE INVENTION

A hydrostatically set packer is held against setting by a locking member that is made of controlled electrolytic material (CEM). After introduction into a wellbore and exposure to thermal or well fluid inputs the lock made of CEM dissolves or is otherwise weakened to the point where relative movement can occur for the setting of the packer with available hydrostatic pressure. The locking member can also be a shape memory alloy at least in part whose shape change allows the tool to set.

DETAILED DESCRIPTION OF THE PREFERRED EMBODIMENT

Figure 1:
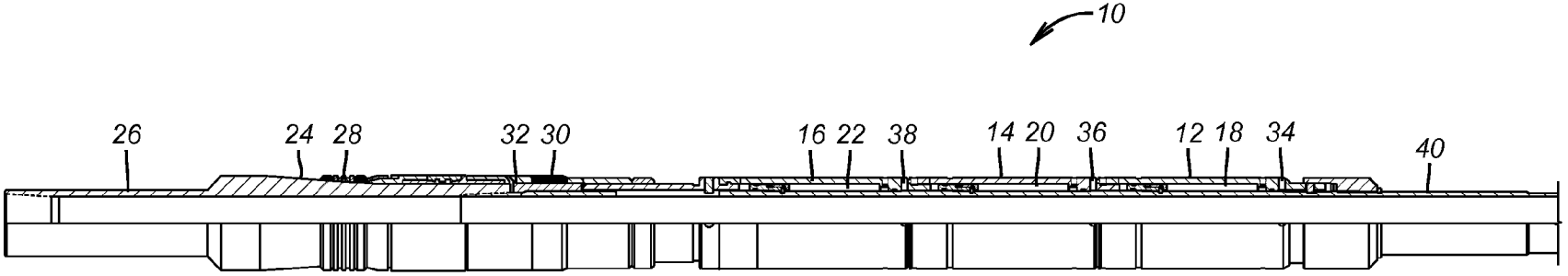
FIG. 1 is a part section view of a hydrostatically set packer in the run in position.
Figure 2:
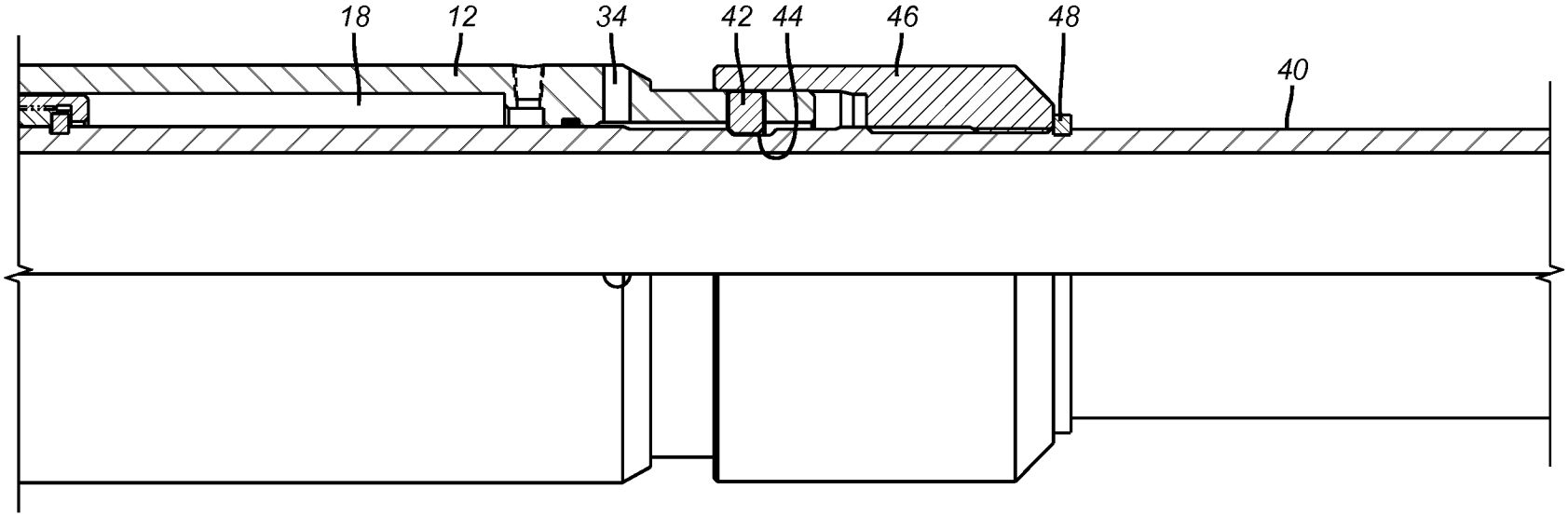
FIG. 2 is a close up view of the locking assembly of FIG. 1 in the run in position.

Referring to FIG. 1, the hydrostatically set packer 10 has attached pistons 12, 14 and 16 for added setting force. A single piston or different amount of pistons can be used depending on the desired setting force. Each piston has an opposed low pressure chamber, respectively 18, 20 and 22. Cone 24 is held stationary from a string that is not shown. The string connects at top sub 26. The slips 28 are moved uphole and radially outwardly on cone 24 until contact with the surrounding tubular is made. Further application of force compresses the seal 30 against the surrounding tubular that is not shown. In this case the slips 28 and the seal 30 are the actuated members. A body lock ring 32 holds the set position. Inlets 34, 36 and 38 admit annulus pressure to pistons 12, 14 and 16 respectively. The pistons 12, 14 and 16 are attached together and initially locked to the mandrel 40 using dogs or a ring 42 that extends into groove 44 in mandrel 40. In this case the pistons 12, 14 and 16 are the actuating members whose movement is directly linked to movement of the actuating member(s). Retainer ring 46 covers dogs or ring 42 to hold the dogs or ring 42 in groove 44, thus serving as a locking member. A snap ring 48 holds the position of ring 46 against movement to the right or downhole. As an alternative to using hydrostatic pressure, a stored potential energy force can be allowed to move a link when the ring or dogs 42 have released the link for movement. The link would then be the actuating member rather than the pistons 12, 14 and 16.

Figure 3:
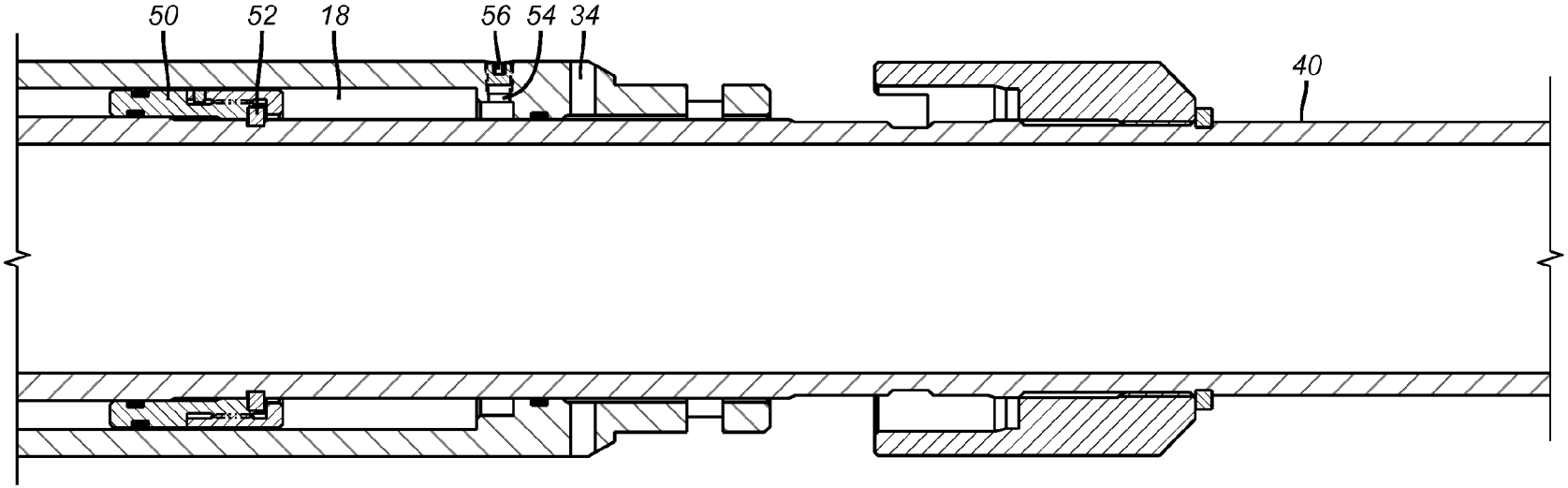
FIG. 3 is the view of FIG. 2 with the lock ring removed due to well fluid exposure.

As shown in FIG. 3 the ring or dogs 42 have disappeared along with their ability to retain the tandem pistons 12, 14 and 16 so that the hydrostatic pressure in the surrounding annulus now can move the tandem pistons 12, 14 and 16 against the low or atmospheric chamber chambers 18, 20 and 22 to reduce their respective volumes against a stationary seal assembly such as 50 that is held to the mandrel 40 by snap ring 52. Each piston has such an assembly of low or atmospheric chamber stationary seal. Optionally, the low or atmospheric chambers can be filled through ports such as 54 with a compressible material and sealed with a plug 56.

Those skilled in the art will appreciate that the lock such as 42 is directly connected to the pistons that move to set the packer. The structural weakening of the lock which is preferably at least in part a CEM material allows the pistons to become unlocked and move to set the slips and seal. The lock is self actuating with time and needs no openings in the wall of mandrel 40 to actuate. By the same token the setting of the tool, in the preferred case a packer, is automatic and time and/or exposure dependent. The lock has to be structurally strong to resist the net hydrostatic forces applied to the piston(s) to allow sufficient time for proper placement of the tool before it automatically actuates. Using the automatic actuation feature avoids the need for surface signaling equipment or processors in the downhole location for signal reception and interpretation. While CEM is preferred other materials can be used such as shape memory alloys or CEM can be used together with shape memory alloys or other materials, that above the critical temperature of the shape memory alloy changes the shape of the shape memory alloy enough to retract out of groove 44. Alternatively structural materials can be combined with materials that weaken under exposure to well conditions sufficiently to let the lock 42 come out of groove 44. The lock 42 can be a composite of a structural material and another material that is dissolved or melts in a way that allows the structural material to shift enough to get out of the groove 44 to allow the tool to set. While packers is the preferred tool, those skilled in the art will appreciate that other types of tools such as sliding sleeves or disconnects for example, can be operated in a like manner. Using the direct locking of the member whose movement actuates the tool there is also no real need for shear pins as in the indirect systems discussed above in the background of the invention.

The above description is illustrative of the preferred embodiment and many modifications may be made by those skilled in the art without departing from the invention whose scope is to be determined from the literal and equivalent scope of the claims below:

We claim:

1. An automatically operating lock for a subterranean tool, comprising:

a mandrel an actuated member on said mandrel selectively movable by an actuating member on said mandrel to define a set position for the tool;

a lock further comprising at least one dog or ring extending through at least one opening in said actuating member to selectively retain said actuating member to a groove in said mandrel by virtue of a covering sleeve supported by said mandrel to define a run in position for the tool, said at least one dog or ring in direct mechanical contact with said actuating member and exposed to subterranean conditions during delivery to a desired subterranean location, said at least one dog or ring automatically releasing said actuating member to move relative to said mandrel in response to adjacent subterranean conditions.

2. The lock of claim 1, wherein:

said lock is initially in contact with said mandrel.

3. The lock of claim 2, wherein:

said lock is made at least in part of a controlled electrolytic material (CEM).

4. The lock of claim 1, wherein:

said at least one dog or ring comprises one piece or a plurality of segments.

5. The lock of claim 4, wherein:

said at least one dog or ring is structurally weakened at least in part from exposure to conditions at a surrounding subterranean location to the point that said at least one dog or ring exit from said groove.

6. The lock of claim 5, wherein:

said at least one dog or ring at least in part dissolve from exposure to conditions at a surrounding subterranean location.

7. The lock of claim 5, wherein:

said at least one dog or ring at least in part react with subterranean fluids to structurally weaken to the point of not being able to retain said actuating member to said mandrel.

8. The lock of claim 7, wherein:

said at least one dog or ring is are made at least in part of a controlled electrolytic material (CEM).

9. The lock of claim 8, wherein:

said actuating component is driven to move by hydrostatic pressure at the subterranean location.

10. The lock of claim 9, wherein:

said actuating component comprises at least one piston released to move against a lower pressure chamber define at least in part by said piston when said lock releases said actuating component from said mandrel.

11. The lock of claim 8, wherein:

said actuating component is driven to move by stored potential energy on said mandrel.

12. The lock of claim 7, wherein:

said lock is made at least in part of a controlled electrolytic material (CEM).

13. The lock of claim 5, wherein:

said at least one dog or ring at least in part melt from exposure to subterranean fluids to structurally weaken to the point of not being able to retain said actuating member to said mandrel.

14. The lock of claim 5, wherein:

said actuated component comprises at least one slip or at least one seal whose radial movement by sliding with respect to a cone is locked against reversal of said movement.

15. The lock of claim 14, wherein:

said mandrel comprises a tubular defined by a wall that has no wall openings.

16. The lock of claim 4, wherein:

said at least one dog or ring is made at least in part of a controlled electrolytic material (CEM).

17. The lock of claim 4, wherein:

said lock is made at least in part of a shape memory alloy whose shape change releases said actuating member from said mandrel.

18. The lock of claim 1, wherein:

said lock is made at least in part of a controlled electrolytic material (CEM).

19. The lock of claim 1, wherein:

said lock is made at least in part of a shape memory alloy whose shape change releases said actuating member from said mandrel.

* * * * *